US010479562B2

(12) United States Patent
Chase et al.

(10) Patent No.: US 10,479,562 B2
(45) Date of Patent: Nov. 19, 2019

(54) PULL RING SEAL SYSTEM FOR CONTAINERS

(71) Applicant: Chase Corporation, Westwood, MA (US)

(72) Inventors: Adam P. Chase, Wellesley Hills, MA (US); Mark Hadley, Kent (GB)

(73) Assignee: Chase Corporation, Westwood, MA (US)

( * ) Notice: Subject to any disclaimer, the term of this patent is extended or adjusted under 35 U.S.C. 154(b) by 0 days.

(21) Appl. No.: 16/023,408

(22) Filed: Jun. 29, 2018

(65) Prior Publication Data

US 2019/0009951 A1 Jan. 10, 2019

Related U.S. Application Data

(60) Provisional application No. 62/528,811, filed on Jul. 5, 2017.

(51) Int. Cl.

| | |
|---|---|
| ***B65D 39/16*** | (2006.01) |
| ***B65D 39/00*** | (2006.01) |
| ***B65D 83/00*** | (2006.01) |
| ***B65D 51/18*** | (2006.01) |

(52) U.S. Cl.

CPC ..... *B65D 39/16* (2013.01); *B65D 39/0052* (2013.01); *B65D 51/18* (2013.01); *B65D 83/00* (2013.01); *B65D 2251/0018* (2013.01); *B65D 2251/0075* (2013.01)

(58) Field of Classification Search

CPC .... B65D 39/16; B65D 39/0052; B65D 51/18; B65D 83/00; B65D 2251/0018; B65D 2251/0075

USPC ..... 222/542

See application file for complete search history.

(56) References Cited

U.S. PATENT DOCUMENTS 664,746 A * 12/1900 Heath ..... B65D 39/16 215/296
664,747 A * 12/1900 Heath ..... B65D 39/16 215/296
723,645 A * 3/1903 Brown ..... B65D 39/16 215/364

(Continued)

FOREIGN PATENT DOCUMENTS

FR 2221354 10/1974

OTHER PUBLICATIONS

International Search Report and Written Opinion in corresponding Application No. PCT/US18/40298 dated Sep. 20, 2018, pp. 1-8.

*Primary Examiner* — Benjamin R Shaw
(74) *Attorney, Agent, or Firm* — Fish & Richardson P.C.

(57) ABSTRACT

Systems and methods for storing a liquid include a container including a body portion defining an internal chamber and at least one opening in communication with the internal chamber, and an insertable plug including a plug body with two rings attached to the plug body via hinges, the insertable plug configured to be inserted into the opening so that a portion of the plug body covers a lip of the opening to restrict access through the opening to the liquid contained in the internal chamber, wherein the hinges can be deformed to raise the two rings away from the plug body. An insertable plug for a container can include a cylindrical plug body, and two rings attached to the plug body by hinges, wherein the hinges can bend to orient the rings towards or away from the plug body.

11 Claims, 6 Drawing Sheets

(56) References Cited

U.S. PATENT DOCUMENTS 773,857 A * 11/1904 Effenberger ..... B65D 39/16 215/299
820,022 A * 5/1906 Smith ..... B65D 39/16 215/300
820,836 A * 5/1906 Voelpel ..... B65D 39/16 215/299
844,400 A * 2/1907 Radbruch ..... B65D 39/16 215/364
1,426,306 A * 8/1922 McFadden ..... B65D 39/16 215/299
1,463,443 A * 7/1923 Cates ..... B65D 51/20 220/258.4
2,234,168 A * 3/1941 Hothersall ..... B65D 51/20 222/542
2,770,383 A * 11/1956 Livas ..... B65D 39/16 215/296
3,200,986 A * 8/1965 La Grutta ..... B65D 39/16 220/791
3,434,620 A 3/1969 Laurizio
4,149,651 A * 4/1979 Ignell ..... B65D 39/16 215/354
4,393,979 A * 7/1983 Ball ..... B65D 17/506 220/270
4,394,922 A * 7/1983 Wimmer ..... B65D 39/16 215/300
4,399,924 A * 8/1983 Nilsson ..... B65D 47/121 220/255.1
4,712,707 A * 12/1987 Pavely ..... B65D 39/00 220/234
4,892,217 A * 1/1990 Shastal ..... B65D 39/16 220/258.3
4,911,323 A * 3/1990 Arfert ..... B65D 41/525 220/254.7
5,496,141 A * 3/1996 Popsys ..... B65D 39/0023 138/89
5,660,302 A * 8/1997 Trout ..... B65D 39/04 215/296
5,799,813 A * 9/1998 Letica ..... B65D 17/506 220/254.1
5,806,710 A * 9/1998 Shiffer ..... B65D 43/0254 220/270
7,607,551 B2 * 10/2009 Coughlin ..... B65D 17/506 220/254.7
8,622,239 B2 * 1/2014 Alvares ..... B65D 43/022 215/396
2003/0192899 A1 * 10/2003 Sturk ..... B65D 43/0212 220/792
2005/0205618 A1 * 9/2005 Mabee ..... B65D 5/746 222/541.9
2007/0075083 A1 * 4/2007 McClellan ..... B65D 51/18 220/258.2
2009/0008355 A1 * 1/2009 Karabin ..... B65D 39/00 215/299
2009/0008400 A1 * 1/2009 Back ..... B65D 41/28 220/783
2009/0277859 A1 * 11/2009 Von Spreckelsen .... B65B 3/022 215/232
2010/0326556 A1 * 12/2010 Martus ..... B65D 39/16 138/89
2011/0233211 A1 * 9/2011 McClellan ..... B65D 51/18 220/258.2
2014/0054301 A1 * 2/2014 Guoqing ..... B65D 47/0885 220/592.17

* cited by examiner

PULL RING SEAL SYSTEM FOR CONTAINERS

RELATED APPLICATION

The present application claims priority to U.S. Provisional Patent Application Ser. No. 62/528,811, filed on Jul. 5, 2017, entitled "Pull Ring Seal System for Containers," which application is incorporated herein by reference in its entirety.

TECHNICAL FIELD

This disclosure relates to sealing of containers.

BACKGROUND

Sealed cans or containers which can be opened to permit the removal of stored contents require an effective seal for the opening. A sealed container must also be airtight so that substances within the container which have a tendency to change their properties when exposed to air may be safely packaged therein.

SUMMARY

When it is desired to provide access to the contents of the container, an access cover seal may be easily lifted away from the container. To facilitate the removal of the seal, it may be provided with a tab portion which may be conveniently gripped with the fingers. The seal is both readily and conveniently removed by peeling off the seal while being sufficiently rugged to withstand the temperatures and the treatment to which such containers are ordinarily subjected, such as temperature changes. An advantage of the present invention is the fact that no tools, such as screw drivers or other implements, are necessary to open the container. The container has a robust seal while allowing the seal to be broken without an individual having to apply excessive force. Further, by assisting the individual to sequentially pull on different leverage points, a cap is easily removable and the probability of having the cap wedged in place is reduced. The insertable plug can be removed uniformly without deforming the plug.

In some aspects, a system for storing a liquid is described. The system includes a system for storing a liquid, comprising a container including a body portion defining an internal chamber and at least one opening in communication with the internal chamber, and an insertable plug including a plug body with two rings attached to the plug body via hinges, the insertable plug configured to be inserted into the opening so that a portion of the plug body covers a lip of the opening to restrict access through the opening to the liquid contained in the internal chamber, wherein the hinges can be deformed to raise the two rings away from the plug body.

In some respects, the plug body is configured to form an interference fit when inserted into the opening. The plug body is configured to form a press fit when inserted into the opening. The opening is an access spout raised from a surface of the container, an outside surface of the access spout having threads. A screw top with threads that mate with the threads of the access spout. The plug body has at least one groove configured to receive an O-ring therein, the O-ring sealingly engaging with the access spout. The insertable plug is configured to be removed from the opening and then re-inserted into the opening.

In other aspects of the invention, an insertable plug for a container includes a cylindrical plug body, and two rings attached to the plug body by hinges, wherein the hinges can bend to orient the rings towards or away from the plug body.

In some respects, the insertable plug of claim 8, wherein the plug body is configured to form an interference fit when inserted into a container opening. The plug body is configured to form a press fit when inserted into a container opening. The insertable plug is made of metal. The insertable plug is made using a one piece steel pressing from a single part of sheet metal. The plug body and the rings are formed of composite materials. T the plug body has at least one groove configured to receive an O-ring therein. In other aspects of the invention, a method of assembling a container includes the steps of providing a container including a body portion defining an internal chamber and at least one opening in communication with the chamber, and inserting an insertable plug including a plug body with two rings attached to the plug body via hinges, the insertable plug configured to be inserted into the opening so that a portion of the plug body covers a lip of the opening to restrict access through the opening to the internal chamber, wherein the hinges can be deformed to raise the two rings away from the plug body.

In some respects, inserting the plug comprises forming an interference fit between the plug body and the opening. Inserting the plug comprises forming a press fit between the plug body and the opening. Attaching a screw top over the opening and the insertable plug.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
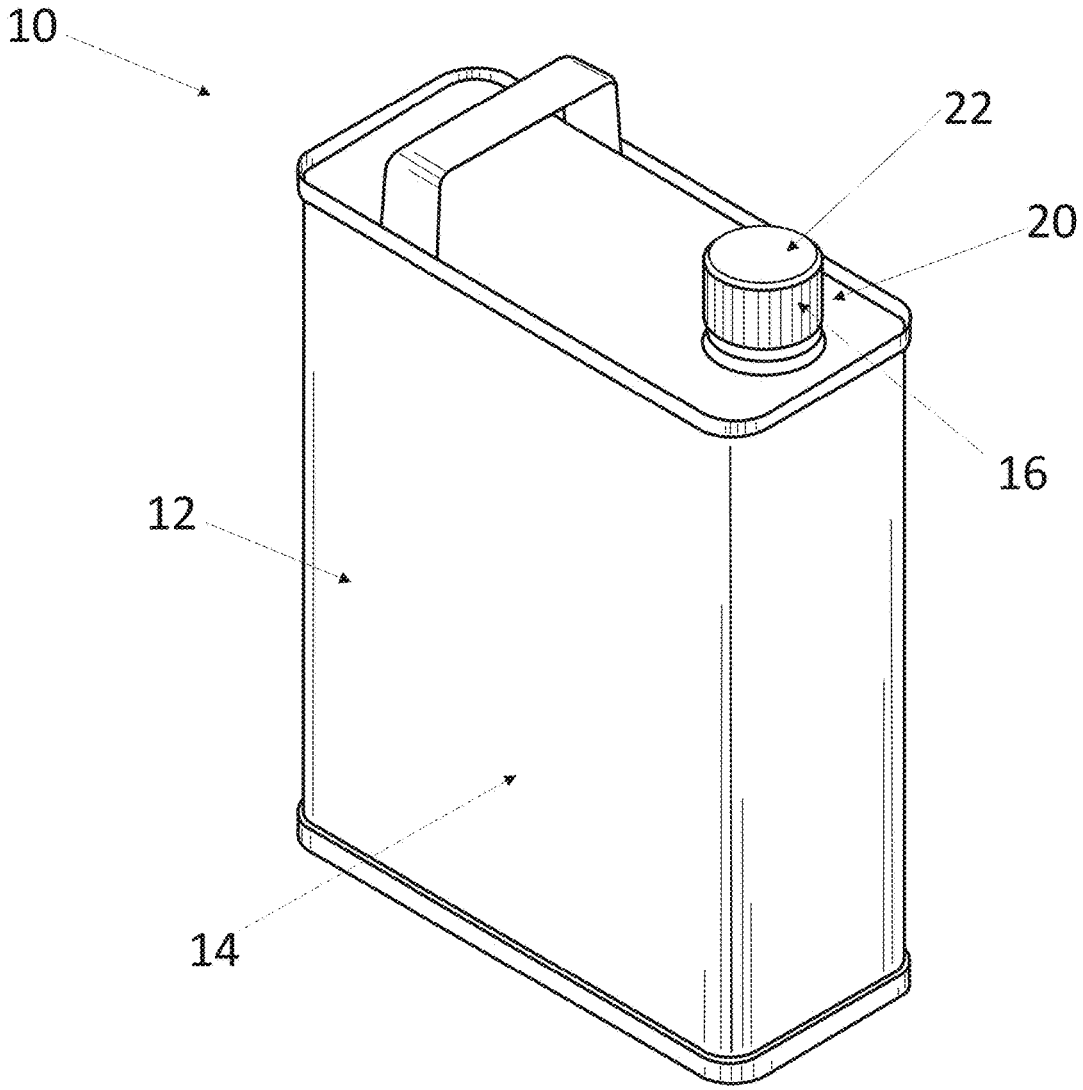
FIG. 1 is a schematic of a container having a screw top.

FIG. 1 shows a container 10 having a body portion 12 defining an internal chamber 14 containing a volatile liquid, such as a flammable chemical, that needs to be contained for long-term storage. The container 10 is shown as having a rectangular geometry, however the container 10 can be of any size, shape, etc. with an internal chamber suitable for holding liquids. The container can be made of any suitable material, e.g., metal.

The container 10 has an opening 16 which in this example includes an access spout 20 for accessing the liquid within the container 10 (e.g., pouring the liquid out from the container 10). The access spout 20 needs to fluidly seal the inside of the container 10 from the environment so that the contents of the container 10 are not exposed to the air so that the contents cannot, for example, evaporate, oxidize or otherwise interact with molecules in the air.

The access spout 20 has two parts or layers of sealing capability. As seen in FIG. 1, the access spout 20 can be raised from the surface of the container 10 and have a first sealing layer in the form of a screw top 22 (e.g., a cap with a threaded interior wall). Referring as well to FIG. 2A, the screw top 22 is screwed on and off from a threaded neck 24 of the access spout 20 in the conventional manner (e.g., via threads located on the inside of the screw top 22 and corresponding threads 26 on the outside of the neck 24).

Once removed, the screw top 22 reveals the secondary layer of sealing for the container 10. Referring to FIG. 2A, this secondary layer of sealing is an insertable plug 30 that forms a seal along the perimeter (e.g., lip 18) of the circular wall of the neck 24 when inserted partially into the neck 24 of the access spout 20. The insertable plug 30 is shaped to fit within the neck 24 of the access spout (e.g., is circular in shape to fit within the circular neck 24 of the access spout 20) with an interference fit or press fit.

Figure 2B:
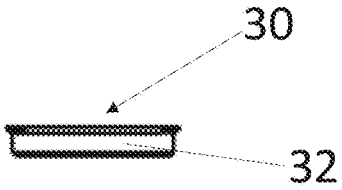
FIG. 2B is a schematic of the insertable plug.
Figure 2A:
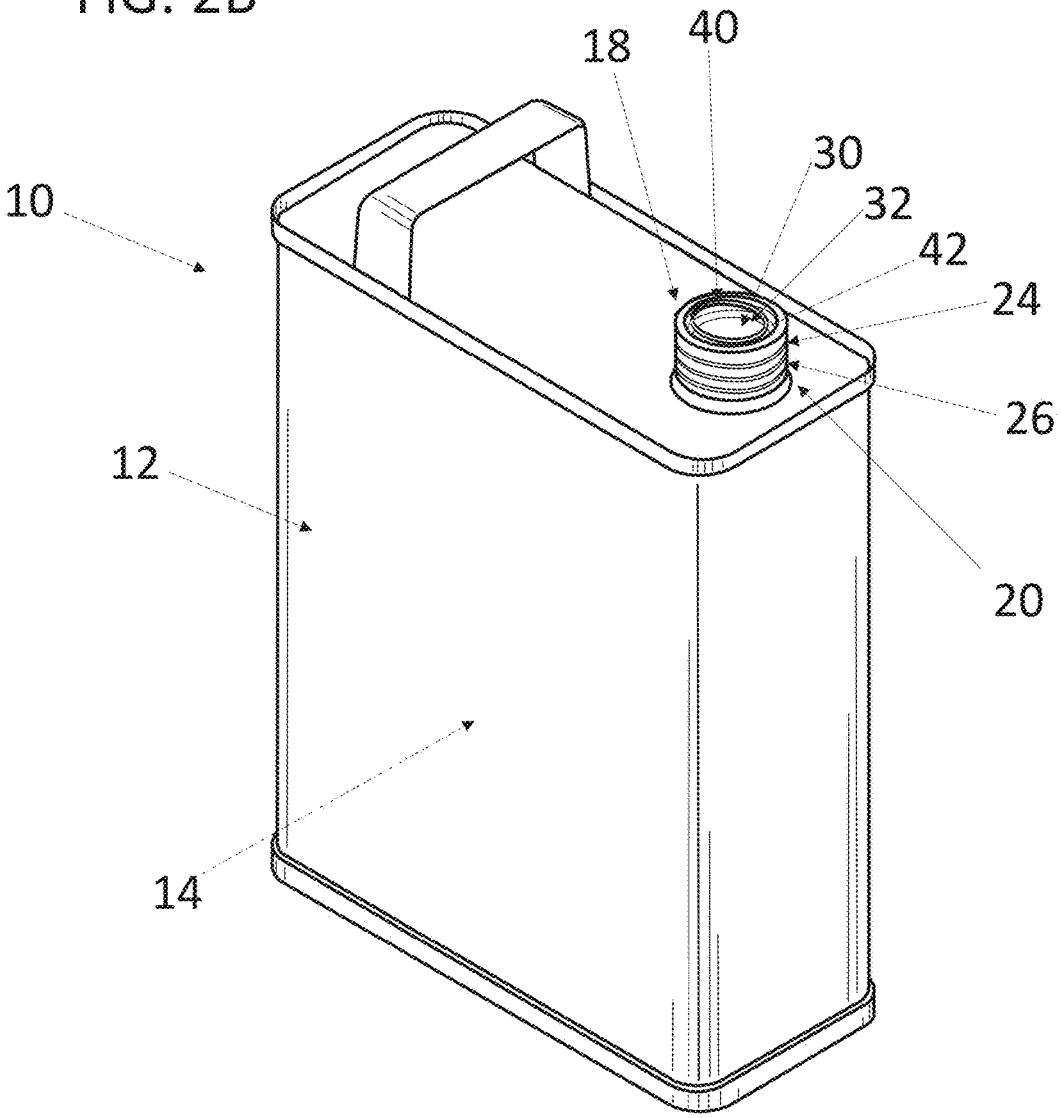
FIG. 2A is a schematic of the container of FIG. 1 with the screw top removed to show an insertable plug with foldable hinged rings.
Figure 3:
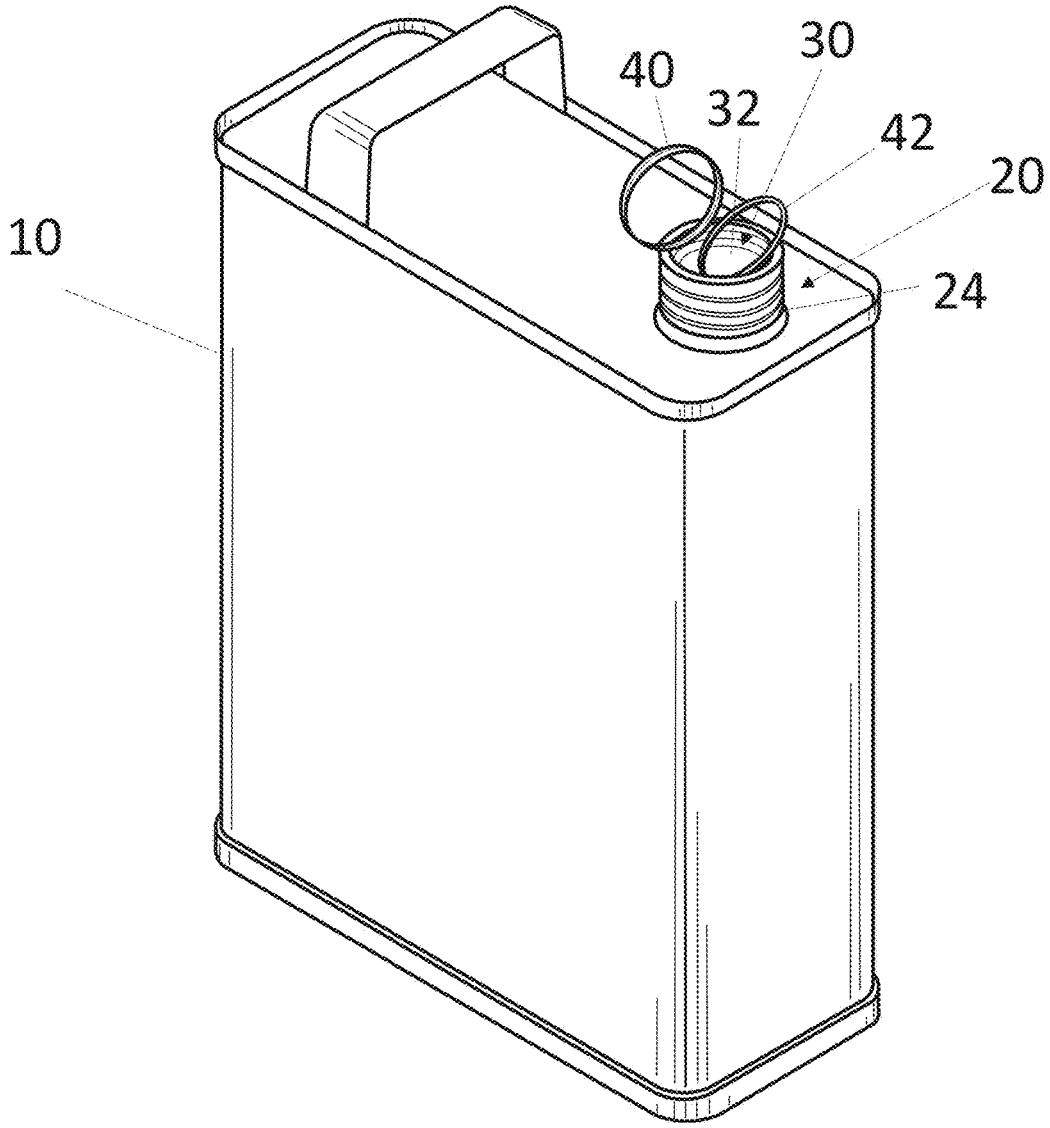
FIG. 3 is a schematic of the container of FIG. 2A with the screw top removed and the ring pulls of the insertable plug unfolded deployed for plug removal.

Referring as well to FIG. 2B, the insertable plug 30 has a plug body 32. When the screw top 22 is removed (e.g., unscrewed) from the access spout 20 (as shown in FIG. 2A), two rings 40, 42 connected to the circumference of the plug body 32 are revealed. The two rings 40, 42 are folded down in a flat profile on top of an upper surface of the plug body 32 of the insertable plug 30. In FIG. 3, the two rings 40, 42 are each rotated away (e.g., plastically deformed) from the upper surface of the plug body 32 of the insertable plug 30.

To remove the insertable plug 30 from the access spout 20, the user first pivots (e.g., bends, rotates, etc.) each of the two rings 40, 42 from the storage position in FIG. 2A to the deployed position in FIG. 3, e.g., folded away from the plug body 32 in a generally upright configuration. The user then pulls on a first one of the rings 40, 42. This breaks the vacuum inside the container 10, and reduces the pressure against which the user must work to remove the insertable plug 30 from the access spout 20. Having broken the seal on one side of the insertable plug's contact with the inside of the neck 24, the user then grasps the second ring 42 and pulls. The insertable plug 30 easily lifts away from the access spout 20 with the pull on the second of the rings 42.

Figure 4A:
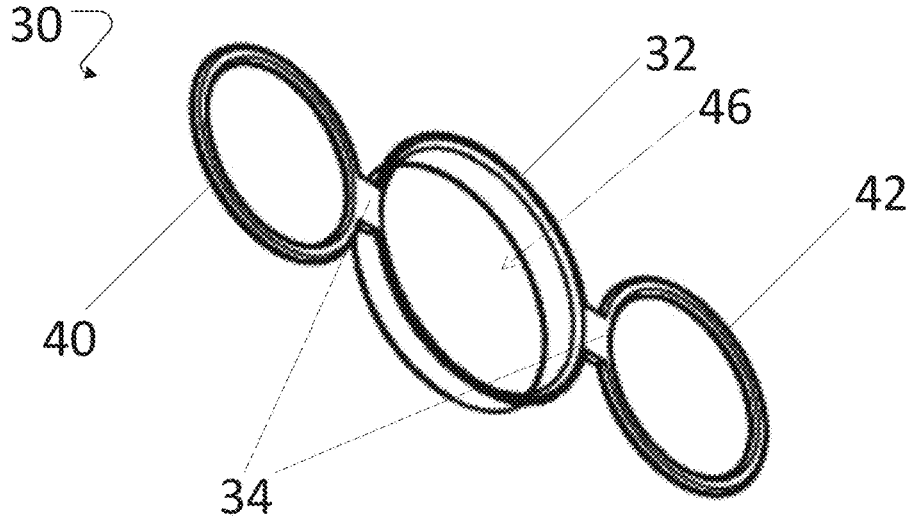
FIGS. 4A-D are views of the insertable plug with ring pulls extended.
Figure 4B:
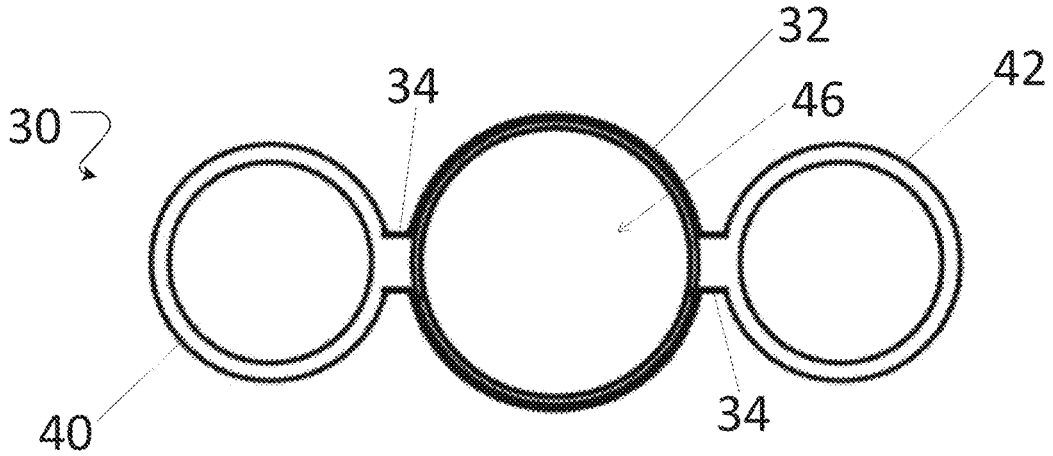
Figure 4C:
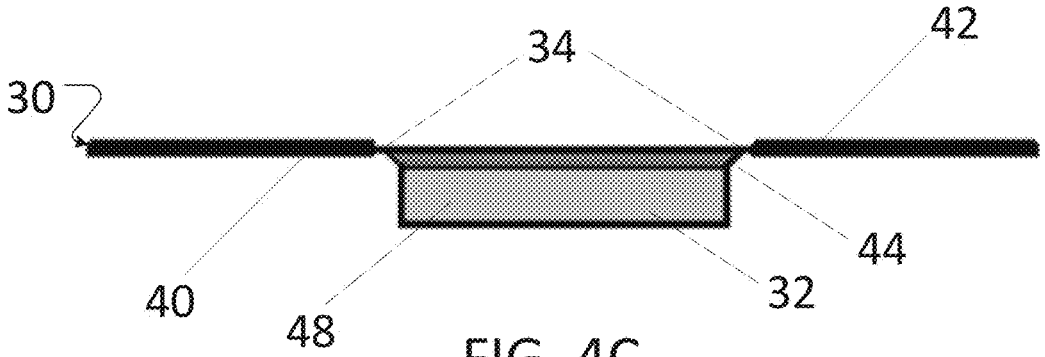
Figure 4D:
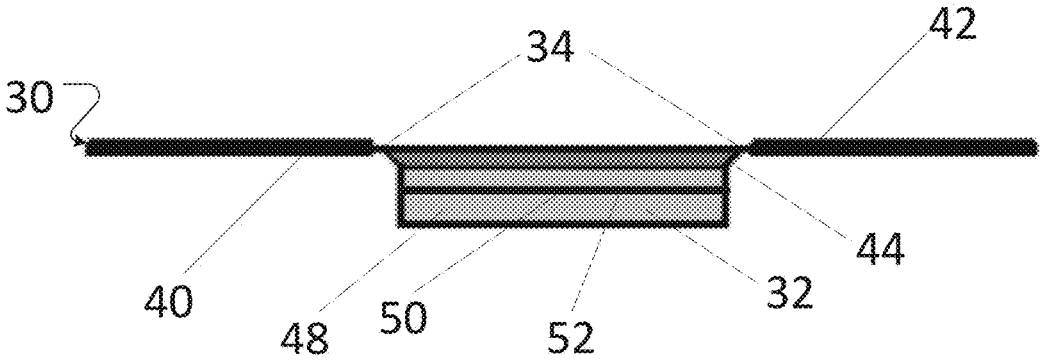

Referring to FIGS. 4A-C, the insertable plug 30 is made of three primary parts, the plug body 32, and the two graspable rings 40, 42 attached to either side of the plug body 32. As best seen in FIG. 4C, the plug body 32 is generally cylindrical (to be capable of fitting within a cylindrical neck 24), with a slightly elongated protrusion 42 whose length protrudes into the neck 24 of the access spout 20. The length of this protrusion 42 can be approximately 5 mm, for example. When inserted into the neck 24, the protrusion 42 presses against the inside of the neck 24 while the top of the body 32 has a flange 44 that seals with the lip of the neck of the access spout 20. The flange 44 can be beveled as shown in FIG. 4C, or can be flat rather than sloped. As best shown in FIG. 4A, the plug body 32 is hollow, allowing for a cavity 46 inside of the protrusion 42. As shown in FIG. 4D, in some implementations, the cylindrical wall of the plug body 32 has a smooth outer wall 48 that includes a groove or channel 50 for one or more O-rings 52. When included, the O-ring 52 reinforces the seal between the plug body 32 and an inside surface of the neck 24.

Figure 5A:
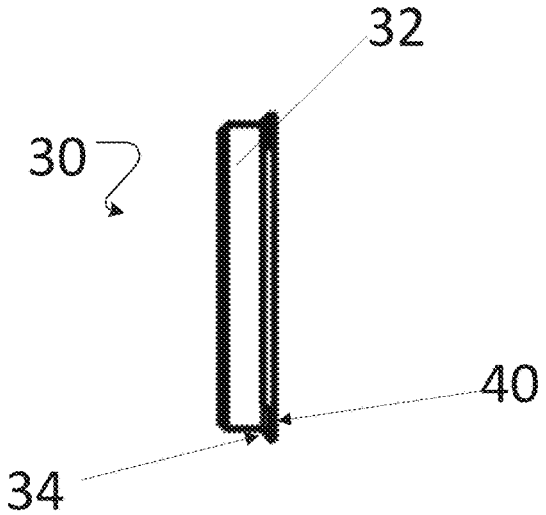
FIGS. 5A-B are views of the insertable plug with ring pulls folded.
Figure 5B:
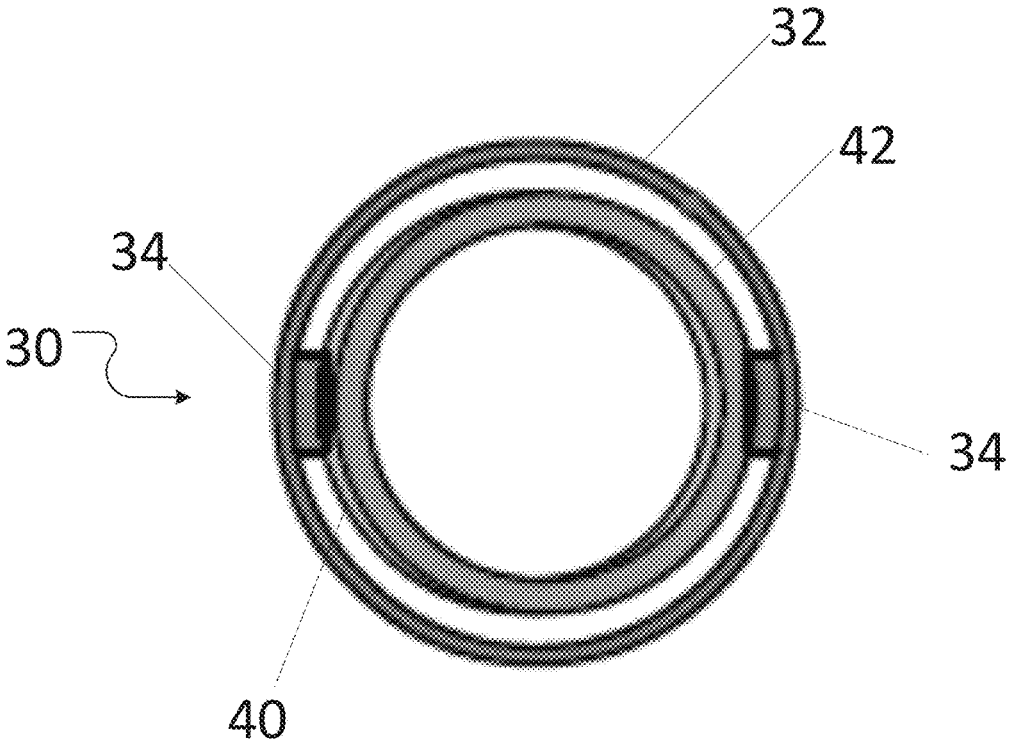

The plug body 32 and the two rings 40, 42 are attached to each other by hinges 34. The hinges 34 are thin, flexible joints that connect each ring 40, 42 to the plug body 32 at the outer diameter of each ring 40, 42 and of the plug body 32. As shown in FIGS. 5A and 5B, each hinge 34 can be oriented so the rings 40, 42 lie flat against the plug body 32. A user can bend or straighten each ring 40, 42 relative to the plug body 32 and the ring 40, 42 will remain in the bent or straightened position. The rings 40, 42 can be bent between the position of FIG. 2A and FIGS. 5A and 5B to the position of FIG. 4 and FIGS. 4A to 5C. Different types of hinges are possible.

The plug body 32 and the two rings 40, 42 can be the same material, e.g., metal. For example, the parts can be tin plate, tin plated steel, aluminum, or stainless steel. The plug body 32 and the two rings 40, 42 can be manufactured using a one piece steel pressing from a single part of sheet metal. In some implementations the body 32 and the two rings 40, 42 can be different materials. The body and the two rings 40, 42 could be composite materials.

The body 32 and the two rings 40, 42 can be monolithic and made of one integral piece. In some implementations the rings 40, 42 and hinges 34 can be attached to the plug body 32, e.g., by welding. In some implementations the hinges 34 are the same, e.g., made of the same material, and the same dimensions as each other. In other implementations each hinge 34 is different. For example, one hinge might be longer than the other, or wider or thicker than the other.

When the insertable plug 30 is pressed into place inside the neck 24 of the access spout 20 with the rings 40, 42 folded down into the cavity 46 as in FIG. 2A, the insertable plug 30 presents a very low profile. Therefore a standard screw top 22 and threads 26 on the outside of the neck 24 can be used, reducing expenses. In some embodiments the screw top 22 can be modified to accommodate the rings 40, 42, for example, by increasing the length of screw top 22.

The insertable plug 20 and the container 10 can be of different sizes. The canister or container 10 can be made of different materials and be configured to hold inks, paints, coatings, and sealants, including chemicals that have high volatility.

An advantage of the dual rings 40, 42 is that their use does not deform the surface of the plug body 32. Once removed, the insertable plug 30 can be re-inserted into the neck 24 and the container 10 can be re-sealed. The dual rings 40, 42 allow the plug to be removed uniformly and without deformation. In some instances, the insertable plug 30 could be re-inserted and the rings 40, 42 bent back (e.g., plastically deformed) into the original position (as shown in FIGS. 5A and B). Once the two rings 40, 42 are bent back to their original flat orientation the screw top 22 can be replaced.

Another particularly important advantage is that no tools, such as screw drivers or other implements, are necessary to open the container. The lack of a prying implement helps to avoid scratching and denting of the seal and/or the container 10. By pulling on a first ring 40 to break the pressure seal inside the container 10 and then pulling on a second ring 42, the insertable plug 30 can be easily removed from the container 10, with little strength or force needed. This is particularly advantageous in embodiments including metal, e.g., where the container 10, the access spout 20, and/or insertable plug 30 are metal, and provide resistance to accessing the fluid within the container 10.

In one example, the insertable plug 30 has a protrusion 42 that is 5.34 mm long (e.g., 4-6 mm) and 30.23 mm (e.g., 29-31 mm) in diameter, while with the flange 44 has a total diameter of 32.33 mm (e.g., 30-33 mm) and the total height of the insertable plug is 6.46 mm (e.g., 5-7 mm). In this example, each hinge 34 is 6 mm wide (e.g., 5-7 mm) and 2.63 mm (e.g., 2-3 mm) long. In other examples, each hinge 34 is 4 mm wide (e.g., 3-6 mm) and 2.63 mm (e.g., 2-3 mm)

long. Each ring 40, 42 has an inner diameter of 22 mm (e.g., 21-23 mm) and outer diameter of 26 mm (e.g., 25-27 mm).

A number of embodiments of the invention have been described. Nevertheless, it will be understood that various modifications may be made without departing from the spirit and scope of the invention. For example, the rings 40, 42 do not need to be symmetrically placed around the plug body 32. Such symmetry allows for ease of use, allowing the insertable plug to be removed uniformly. However such symmetry is not necessary and one ring can be placed at less than 180° from the other. In other embodiments, more than two rings are possible (e.g., 3 or more rings). Accordingly, other embodiments are within the scope of the following claims.

What is claimed is:

1. A system for storing a liquid, comprising:

a container including a body portion defining an internal chamber and at least one opening in communication with the internal chamber; and an insertable plug including a plug body with two rings attached to the plug body via hinges, each hinge attached to an outside surface of an outer circumference of the plug body at a single point, the insertable plug configured to be inserted into the opening so that a portion of the plug body covers a lip of the opening to restrict access through the opening to the internal chamber, wherein the hinges can be deformed to raise the two rings away from the plug body.

2. The system of claim 1, wherein the plug body is configured to form an interference fit when inserted into the opening.

3. The system of claim 1, wherein the plug body is configured to form a press fit when inserted into the opening.

4. The system of claim 1, wherein the opening is an access spout raised from a surface of the container, an outside surface of the access spout having threads.

5. The system of claim 4, comprising a screw top with threads that mate with the threads of the access spout.

6. The system of claim 4, wherein the plug body has at least one groove configured to receive an O-ring therein, the O-ring sealingly engaging with the access spout.

7. The system of claim 1, wherein the insertable plug is configured to be removed from the opening and then re-inserted into the opening.

8. A method of assembling a container, comprising the steps of:

providing a container including a body portion defining an internal chamber and at least one opening in communication with the internal chamber; and inserting an insertable plug including a plug body with two rings attached to the plug body via hinges, each hinge attached to an outside surface of an outer circumference of the plug body at a single point, the insertable plug configured to be inserted into the opening so that a portion of the plug body covers a lip of the opening to restrict access through the opening to the internal chamber, wherein the hinges can be deformed to raise the two rings away from the plug body.

9. The method of claim 8, wherein inserting the plug comprises forming an interference fit between the plug body and the opening.

10. The method of claim 8, wherein inserting the plug comprises forming a press fit between the plug body and the opening.

11. The method of claim 8, comprising attaching a screw top over the opening and the insertable plug.

* * * * *